US008296958B1

(12) United States Patent
Frazer

(10) Patent No.: US 8,296,958 B1
(45) Date of Patent: Oct. 30, 2012

(54) FOLDING KNIFE WITH MECHANISM TO REPOSITION BACK BAR

(75) Inventor: Spencer Frazer, Lynnwood, WA (US)

(73) Assignee: SOG Specialty Knives and Tools, LLC, White Plains, NY (US)

( * ) Notice: Subject to any disclaimer, the term of this patent is extended or adjusted under 35 U.S.C. 154(b) by 766 days.

(21) Appl. No.: 12/022,928

(22) Filed: Jan. 30, 2008

(51) Int. Cl.
*B26B 3/06* (2006.01)
*F41B 13/02* (2006.01)
*F41C 27/18* (2006.01)

(52) U.S. Cl. ..... 30/161; 30/155; 30/158; 30/160

(58) Field of Classification Search ..... 30/155, 30/158, 159, 160, 161, 307, 319, 164, 95, 30/365, 114, 2, 151, 162, 286, 289, 292, 30/293
See application file for complete search history.

(56) References Cited

U.S. PATENT DOCUMENTS 4,240,201 A 12/1980 Sawby et al.
4,535,539 A * 8/1985 Friedman et al. ..... 30/161
4,570,341 A * 2/1986 Konneker ..... 30/161
4,974,323 A 12/1990 Cassady
4,985,998 A 1/1991 Howard
5,442,855 A 8/1995 Jobin
5,461,786 A * 10/1995 Miller ..... 30/161
5,511,310 A * 4/1996 Sessions et al. ..... 30/161
5,979,065 A 11/1999 Hsu
6,079,106 A * 6/2000 Vallotton ..... 30/161
6,158,127 A 12/2000 Taylor
6,256,888 B1 * 7/2001 Shuen ..... 30/161
6,668,460 B2 * 12/2003 Feng ..... 30/161
6,941,661 B2 9/2005 Frazer
7,062,857 B1 * 6/2006 Nenadic ..... 30/161
7,080,423 B2 7/2006 Seber et al.
7,140,110 B2 11/2006 Lake
7,146,736 B1 * 12/2006 Collins ..... 30/160
2003/0213134 A1 11/2003 Sakai
2005/0044717 A1 3/2005 Nishihara
2005/0183268 A1 * 8/2005 Chen ..... 30/161
2006/0200995 A1 9/2006 Anderson
2006/0248727 A1 11/2006 Kain
2007/0214652 A1 * 9/2007 Ping ..... 30/161

* cited by examiner

*Primary Examiner* — Ghassem Alie
*Assistant Examiner* — Bharat C Patel
(74) *Attorney, Agent, or Firm* — Forrest Law Office, P.C.

(57) ABSTRACT

A folding knife having a back bar configured to engage the tang portion of a blade. A release member mechanism is utilized to engage the back bar to apply force thereto to at least partially disengage the back bar from the tang portion of the blade for purposes of repositioning the blade with respect to the handle.

6 Claims, 8 Drawing Sheets

FOLDING KNIFE WITH MECHANISM TO REPOSITION BACK BAR

BACKGROUND OF THE DISCLOSURE

Folding knives commonly have lock mechanisms such as a lock back bar which may be pivotally attached to a first transverse region of the handle (also referred to as an upper region) of the handle. Lock back bars in general and have a longitudinally forward region which engages a blade and more particularly the tang region of a blade. The tang region of the blade is a surface which generally has a portion that is at least partially curved, having in some forms one or more recess portions. The recess portions can generally be such that the blade can be biased to merely reposition the lock member to somewhat restrict the motion of the blade, or there can actually be a notch-like mechanism to lock the blade in an open orientation.

Oftentimes a lock back bar is configured similar to a first-degree lever where there is a pivot attachment in between the tang engagement portion of the lock back bar and the user engagement portion, which in one form is a portion of a lock back bar configured to be depressed, which is usually in the longitudinally rearward portion of the handle. In other words, the lever-like action by pressing the lock back bar at the user engagement portion disengages the tang engagement portion of the lock back bar from the tang of the blade.

Certain prior art devices have been utilized for disengaging a lock member from the blade. References such as U.S. Pat. No. 4,240,201 show a folding knife where the actuator means is a pushbutton device which engages a bar spring in a manner such that an oblique surface repositions the bar spring to disengage the tang portion, and more particularly the lock notch indicated at 32 in that disclosure.

Other references show types of disengaging members, such as U.S. Pat. No. 5,442,855 which shows the concept of a pushbutton mechanism which engages a pivoted flexible leaf-like member which has an upper portion that engages a spring biased locking strip.

Other references show different ways of disengaging a lock mechanism, such as U.S. Pat. No. 4,985,998 which shows a release lever in FIG. 2 which is pivotally attached to the blade and a projection 34 is configured to lift the locking lug.

Therefore, there is an absence of the concept of a lock release mechanism which in one form can be utilized in one or two modes. One mode involves engaging the lock bar itself, or alternatively engaging a release lever to disengage a tang engagement portion of the tang of the blade. In other forms, as disclosed herein, an engagement surface configured to engage the lock bar is disclosed herein, and in one form having a release member that is pivotally attached to the handle along a lateral axis is shown with a lateral engagement member extending through a surface defining an opening in the handle. Therefore, repositioning the release member provides engagement of a cam surface of the release member to the lock back bar to disengage the tang engagement member of the tang of the blade.

SUMMARY OF THE DISCLOSURE

Disclosed herein are various embodiments of locking system otherwise referred to as a lock/unlock system for a folding knife. In general disclosed herein is a handle having a forward region and a rearward region. There is a blade pivotally attached to the handle at the forward region. The blade having a tang region which is basically a base region of the blade and there is a tang surface. In one form the tang surface has a tang indentation.

Now there is a blade engaging member provided that is movably attached to the handle. The blade engaging member has a tang engagement portion configured to engage the tang surface of the blade.

In one form there is a biasing member configured to bias the lock back bar so the tang engagement portion forcefully engages the tang surface. There is a release member operatively configured to reposition the blade engaging member to lower the closing rotational resistance upon the blade.

The blade engaging member can be orientated to reposition in a direction away from the tang surface by repositioning the release member where the release member repositions the blade engaging member to lower the rotational resistance upon the blade. In this manner the blade engaging member can independently reposition in a direction away from the tang surface by applying a force directly to the blade engaging member.

This locking system where blade engaging member is a lock back bar and the release member being positioned to be movably attached to the handle so a cam surface of the release member engages the lock back bar, the release member having a lateral engagement member extending through a surface defining an opening in the handle on the lateral region of the handle.

The release member can be pivotally attached to the handle and have a first position where the cam surface is such that a first contact location between the release member and the lock bar is at a shorter distance than when the release member is in a second position. In the second position the second contact location between the cam surface of the release member and the lock back bar comprises a greater second distance than the first distance.

In one form the blade engaging member has a transverse engagement region which is configured to be pressed to disengage the tang engagement portion of the lock back bar from the tang surface.

The tang surface further has a lock notch where the tang engagement portion of the blade engaging member partially disengages from the tang engagement surface for a first portion of rotation of the blade with respect to the knife and the tang engagement portion of the blade engaging member is configured to engage the lock notch when the blade is in an open position. When the release member is repositioned to a second position the tang engagement portion of the lock bar disengages from the lock notch so the blade can reposition from the open position to the closed position.

A method of opening a blade of a folding knife is disclosed herein. The method begins and continues (not necessarily in the presented order) by grasping the handle region of a blade at an upper transverse region. In this manner the knife handler can expose a lower blade access slot at an opposing transverse region of the handle. Then the knife handler repositioning a release mechanism which is operatively connected to a lock back bar so as to disengage a tang engagement portion of a lock back bar from the tang of a blade that is pivotally attached to the handle.

The action of the release mechanism allows a sufficient amount of reduced rotational resistance of the blade with respect to the handle, whereby applying a rotational acceleration to the handle while the release mechanism maintains the lock back bar in a higher energy stored state so the blade can reposition from a closed orientation within the handle out of the lower blade access slot towards an open orientation.

There after the knife handler can release the lock back bar to a lower stored energy state whereby the tang engagement portion engages a lock notch position on the tang region of the blade, thereby locking the blade to a fully open orientation, whereas the lock back bar can operate independently of the release mechanism to reduced rotational resistance of the blade with respect to the handle.

In one form the release mechanism is configured to have a lateral engagement member extending to an open region of the handle. In this form the release mechanism is pivotally attached to the handle and a cam surface is configured to contact an engagement surface of the lock back bar.

With regard to the apparatus itself the release mechanism attached to the handle where an engagement member is operatively configured to engage and reposition the lock back bar to an unlocked orientation. The tang engagement portion disengages from the tang portion of the blade. The release mechanism further being operatively configured to directly engage the blade to reposition the blade from the closed position within the recess of the handle to a non-closed position. In this form the engagement member of the release mechanism is configured to engage the blade as opposed to the lock back bar in a mutually exclusive manner. The release mechanism can be pivotally attached to the handle and a lateral engagement surface extending through a surface of the handle is positioned at an opposing longitudinal region with respect to the engagement member.

Further described a rotational member engagement system for a folding knife. In this form of description there is provided a blade having a tang region with a tang surface where the tang surface in one form is on the circumferential end of the knife and has a tang indentation. The blade engaging member is attached to the handle and the blade engaging member has a tang engagement portion configured to engage the tang surface of the blade. A release member is pivotally attached to the handle and operatively configured to reposition the blade engaging member to lower the closing rotational resistance upon the blade where the rotational amount of the release member is greater than the rotational amount of the blade engaging member providing mechanical advantage to reposition the blade engaging member. In one form the release member has a cam surface configure to engage blade engaging member for repositioning the same.

Further described is a flick knife configured to open in one form by reducing the rotational resistance upon the blade and the blade can be open by 'flicking' the wrist or otherwise providing a rotational acceleration thereupon.

In this form the release mechanism which is operatively connected to the handle to engage the blade to reposition the blade in an opening direction when the blade is positioned a closed position in the recess region of the handle. The release mechanism is operatively configured to reposition the blade to a partially open system so as to place the blade engaging member in a higher stored energy state so as to reduce the rotational resistance acting upon the blade.

The flick knife in one form can be arranged so repositioning the blade to a partially open orientation allows a sufficient amount of reduced rotational resistance of the blade with respect to the handle allowing a rotational acceleration to the handle while the release mechanism maintains the blade engaging member in a higher energy stored state the blade can reposition from the closed position within the handle out of the lower blade access slot towards an open orientation.

Of course other forms of carrying out the applicant's concept can be performed.

DESCRIPTION OF THE PREFERRED EMBODIMENTS

Figure 1:
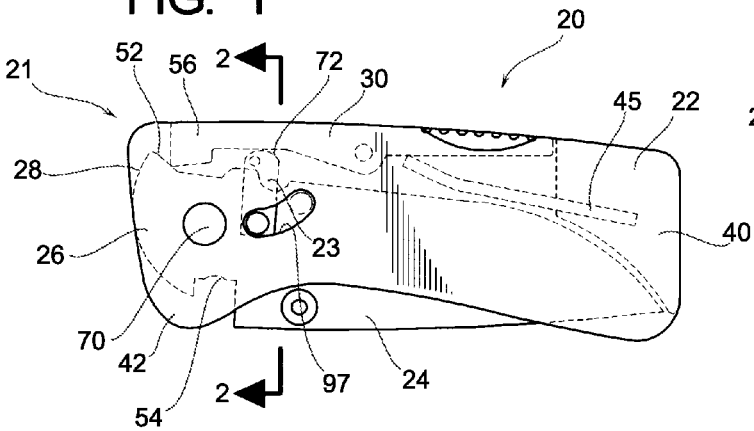
FIG. 1 shows a side view of a folding knife.

As shown in FIG. 1, there is a folding knife 20 with a handle 22 and a blade 24. The blade has a tang region 26 which is comprised of a tang surface 28, described further herein. The blade is pivotally attached at the pivot attachment location 70. In general, the folding knife 20 comprises a locking assembly 21 which in one form is a lock bar having a lock back bar member 30 described further herein. Further, a release member 23 is provided as shown in FIGS. 3 and 4 which is operatively configured to engage the lock back bar to provide a cam-like engagement for disengaging the tang engagement portion 56 of the lock back bar from the tang indentation 52 which are both described further herein.

Figure 2:
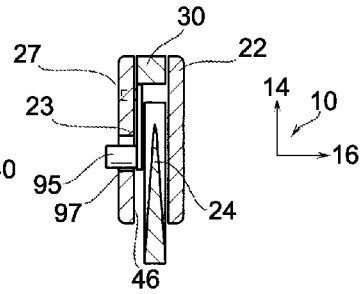
FIG. 2 shows a sectional view taken at line 2-2 of FIG. 1.
Figure 3:
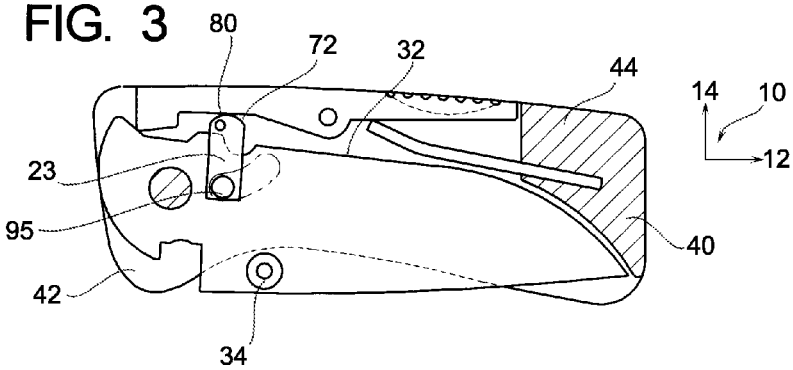
FIG. 3 is a partial sectional view showing various components of a locking system for a folding knife.
Figure 4:
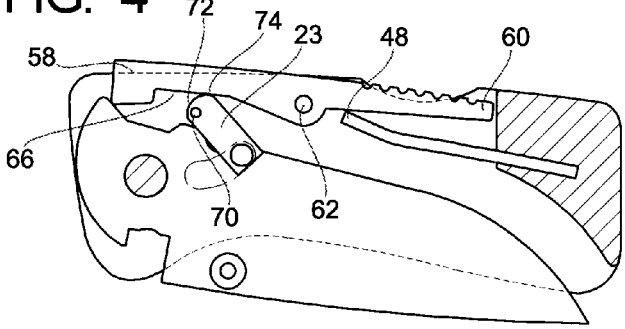
FIG. 4 shows the release member engaging the lock back bar where the cam surface of the release member engages a second contact location of the lock back bar.
Figure 10:
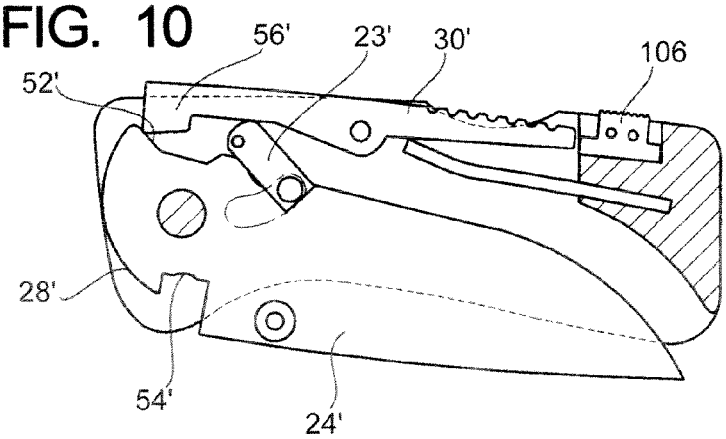
FIG. 10 shows the blade starting in a partially open orientation.

Before further describing one embodiment of the applicant's concept, the axes system will now be defined indicated in FIGS. 2, 3 and 10. In general, the axis 12 is a longitudinal direction and the axis 14 is a transverse direction. As shown in FIG. 2, the axis 16 points in a first lateral direction. Of course, the release member 23 can be positioned on either side of the blade member 24, and in some forms could be positioned on both sides where the surface defining the opening 97 could be replicated on the opposing lateral side of the handle 22.

The blade 24 further comprises a sharpened edge 32 which is optimally configured to fit within the handle 22 within the surface defining the internal cavity 46. In one form, as shown in FIG. 3, the blade can have a thumb stud 34 which is ergonomically configured in one form to engage the thumb of the user to assist in opening the blade. In one form, assisted opening technology could be utilized and the blade 24 can be opened as an assisted-type knife utilizing the assisted opening as shown in U.S. Pat. No. 6,941,661 which is fully incorporated by reference. Further, other assisted opening technologies can be incorporated to the design such as U.S. Pat. No. 5,802,722, U.S. Pat. No. 6,397,476 and U.S. Pat. No. 5,815,927 which are all fully incorporated by reference. However, as further described herein, the release member 23 in one form can disengage the frictional force from the tang engagement portion 56 from the tang indentation 52, thereby releasing the counterforce acting upon the blade such that the blade will operate as a traditional switchblade.

Referring now back to the technical description, the handle member 22 is comprised of a rearward region 40 and a forward region 42. The base portion 44 has the biasing member 45 fixedly attached therein where the forward end 48 is configured to engage the longitudinal rearward portion 60 of the lock bar 30. As shown in FIG. 2, the handle 22 has the surface defining the inner cavity 46 which was previously introduced above.

The blade member 24 having the tang region 26 comprises the tang indentation 52 and the tang surface 28 as well as, in one form, the locking notch 54. The tang surface can be the outer portion or lateral portion of the base region of the blade member 24. The lock back bar 30 is comprised of a tang engagement portion 56 which is optimally configured to engage the tang region 26. The lock back bar in the broader scope is a "blade engaging member" that engages the knife to apply force thereagainst to resist rotation of the blade with respects to the handle and further where the release member is configured to reposition the blade engaging member to lower the closing rotational resistance upon the blade. In one form the tang engagement portion 56 engages the out tang portion, but in other forms the tang engagement region of the lock back bar is defined as, and could be for example, a mechanism such as a liner lock engaging the lateral portion of the tang or a spring biased spherical member engaging an indentation anywhere on the tang (base region) of the knife. Further the lock back bar need not be a lock bar but is defined also as a back bar.

The lock back bar in general comprises the longitudinally forward region 58 and the longitudinal rearward region 60 as shown in FIG. 4. In one form, the lock back bar is pivotally attached between the regions 58 and 60 at the pivot location 62. As shown in FIG. 4, in the lower portion of the longitudinal forward region 58 there is an engagement surface 66 which is optimally configured to engage the cam surface 72 of the release member 23. The release member 23 is pivotally attached to the handle at the pivot attachment location 70. As shown in FIG. 1, the release member 23 is provided with a cam surface 72. The cam surface can have a variety of contours as described further herein, but in general the cam surface 72 is configured to contact the engagement surface 66 of the lock back bar 30 for repositioning the lock back bar into a disengaged orientation (see FIG. 4). Referring now to FIG. 3, it can be seen how the cam surface 72 of the release member 23 is in engagement at a first contact location 80. Now referring to FIG. 4, it can be appreciated how the cam surface 72 is now in engagement with the engagement surface 66 at a second contact location 74.

Figure 5:
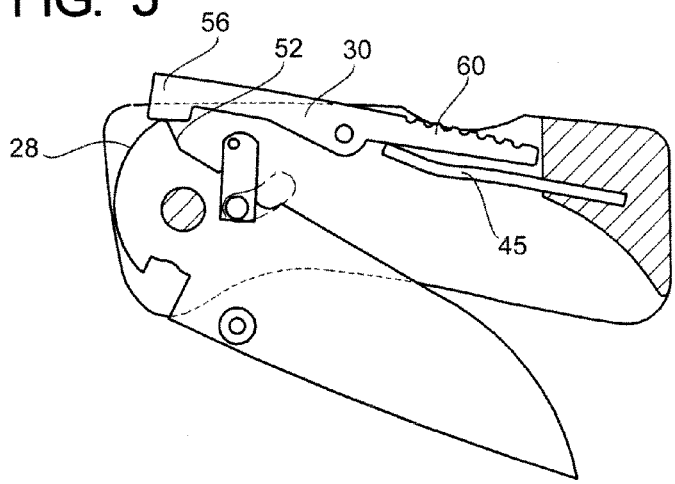
FIG. 5 shows the blade in a partially open orientation.
Figure 6:
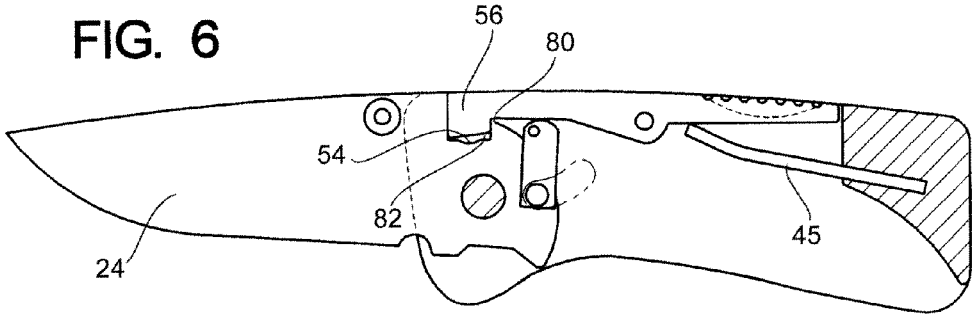
FIG. 6 shows the blade in an open position where the tang engagement portion of the lock bar is an engagement with the lock notch of the tang surface of the blade.

Now referring to FIG. 5, it can be appreciated that the tang engagement portion 56 of the lock back bar 30 is in a stored energy state where the engagement between the longitudinally rearward portion 60 of the lock back bar and the biasing member 45 places the biasing member 45 in a higher stored energy state. Of course, there can be other orientations of the biasing member and other types of biasing members, such as coil springs or the like. At any rate, the tang engagement portion 52 is in forceful engagement with the tang indentation 52 as it slides to the orientation as shown in FIG. 5. Thereafter, the tang engagement portion 52 engages the tang surface 28 until the blade 20 is in the open position (see FIG. 6). In this orientation, the tang engagement portion 56 is positioned in the locking notch 54. In one form, the locking notch is provided and the tang lock surface 80 is in engagement with the notch blade lock surface 82 to prevent a rotation of the blade 24 in a closing direction.

Figure 7:
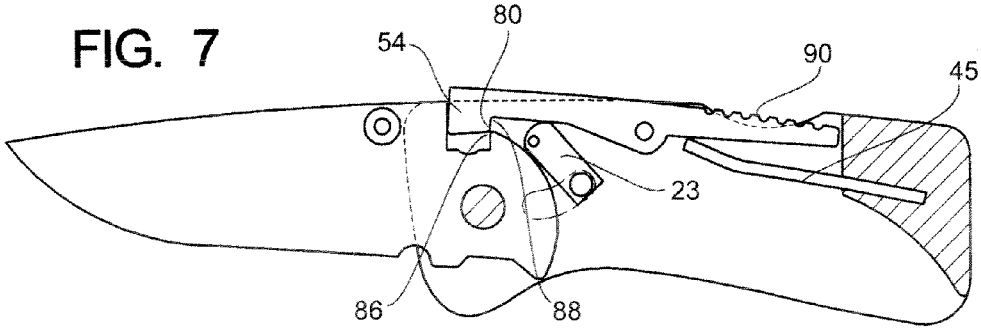
FIG. 7 illustrates the principle of repositioning the release lever to a second position, thereby disengaging the tang engagement portion from the lock notch of the blade.

Now referring to FIG. 7, it can be appreciated that the release member 23 is repositioned to a second orientation, and the lower corner region 86 of the tang lock surface 80 is in disengagement with the upper corner region 88 of the blade lock surface, thereby allowing the blade to rotate in a closing direction. Of course in one form the transverse region 90 can be depressed like a traditional lock back bar. Alternatively, the release member 23 can be employed for disengagement. Of course, in another form the upper surface in the rearward and of the lock bar is exposed so as to function as a regular lock bar. Alternatively, this portion can be unexposed such that the only means for unlocking the knife would be by way of the release member.

The release member 23 further comprises a lateral engaging member 95 which in one form (as shown in FIG. 1) extends beyond a surface defining an opening in the handle indicated at 97. In general, the lateral release member 95 can extend beyond the lateral plane of the handle 27, as shown in FIG. 2. Alternatively, this lateral release member can be recessed therein. The outer lateral surface of this handle can be gnarled or otherwise provide a gripping surface for frictional engagement thereof.

Figure 13:
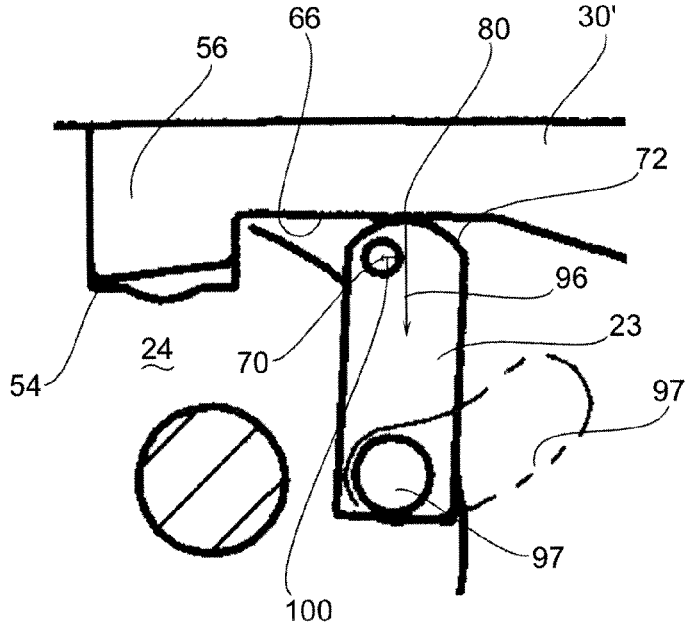
FIGS. 13-14 shows a close up view of the release member in one form.

Referring ahead to FIG. 13, it can be seen how the release member 23 is in the first position and the tang engagement portion 56 is in engagement with, for example, a lock notch 54 which is a portion of the blade indicated at 24. Therefore, it can be appreciated how in one form, the first contact location 80 corresponds to a first vector 96 which is a resultant force between the contact of the cam surface 72 and the engagement surface 66. The tang engagement portion can be attached to a pivoting lock bar such as that described above or can be a back bare fixedly attached to the handle at a location in the longitudinally rearward portion thereof. Therefore in this form the bar member 30' would be a cantilevered spring like member. Of course other locking mechanisms and tang engagement methods can be employed. With a cantilevered like spring the force upon the tang can be substantial. Therefore having leverage where the distance from the center of rotation of the release member 23 to the lateral engaging member 95 is greater than the distances 100 and 102 whereby providing leverage upon the bar 30'.

Figure 14:
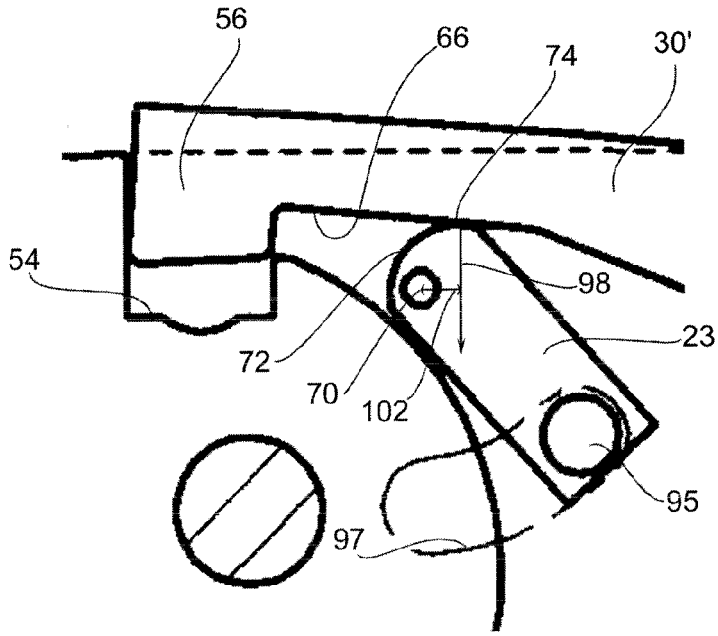

Now referring to FIG. 14, it can be appreciated that the release member 23 is in the second position, and further shown in FIG. 14 is a second vector and 98. As with the first vector 96, the second vector 98 is a resultant vector between the surfaces 72 and 66 and is a substantially normal vector to the surface 66 at the second contact location 74. In one form, the leverage distance between the pivot location 70 and normal to the first vector 96 is indicated by distance 100. As shown in FIG. 14, the corresponding distance 102 is a greater value, thereby adjusting the leverage in this case to require additional force upon the lateral engaging member 97. In other words, as shown in FIG. 7, the biasing member 45 is in a higher stored energy state, and in general a spring member increases in force with respect to its displacement. Therefore, not only does the force upon the lateral engagement member 95 increase because the magnitude of the second vector 98 is greater, but further because the leverage distance 102 increases with respect to the distance 100 (see FIGS. 13 and 14) and requires further force to disengage the tang engagement portion 56 from the lock notch 54. This provides a safer locking mechanism which ensures that the blade remains locked unless the user applies sufficient force to unlock the blade. Of course, unlocking the blade allows it to close which of course is problematic when this happens unexpectedly, particularly when the user's fingers are positioned along the open region of the handle in the lower transverse portion which is in the path of the sharpened edge of the blade as it closes.

It should be further noted with reference to FIGS. 13 and 14 that in addition to having a greater amount of force required to unlock the blade, the amount of travel of the tang engagement portion 56 increases with respect to the rotation of the release member from the first position (FIG. 13) to the second position (FIG. 14). In other words, this particular arrangement requires less actual motion of the release member 23 to accomplish the unlocking of the blade.

Figure 8:
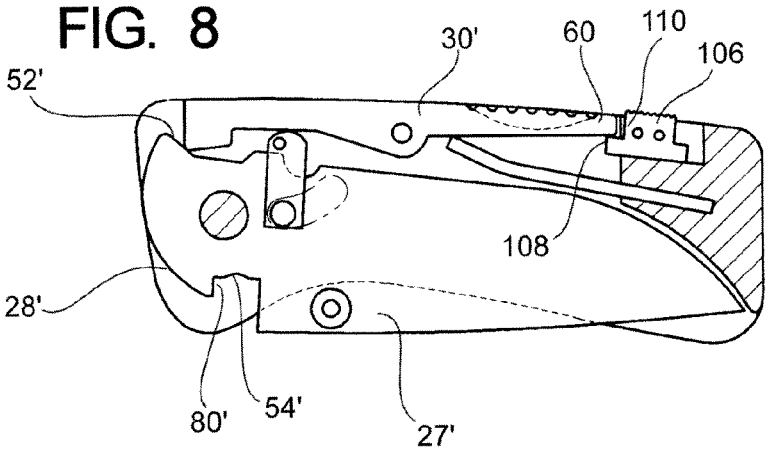
FIG. 8 shows another embodiment where a secondary lock is provided which is configured to engage a longitudinally rumored portion of the lock back bar in one form.
Figure 9:
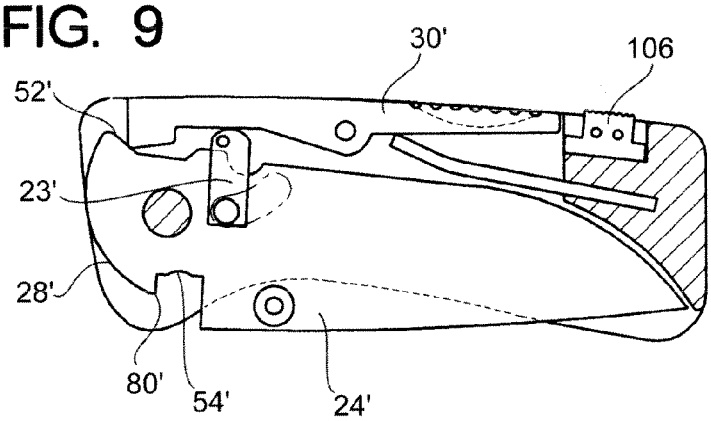
FIG. 9 shows the secondary lock in a second position to allow travel of the lock back bar.

Now referring to FIG. 8, there is shown a second embodiment where a secondary lock 106 is employed. In general, the lock back bar 30' has the longitudinally rearward portion 60, where in one form the secondary lock surface 108 is provided which is operatively configured to engage the lock surface 110 of the secondary lock 106 as shown in FIG. 8. This provides a safety to keep the knife locked closed as shown in FIG. 8, or alternatively locked in an open orientation. As shown in FIG. 9, it can be appreciated that the secondary lock 106 is a second position which allows a clockwise movement of the lock back bar 30' which is shown in FIG. 10.

Therefore, it can be appreciated that the blade 24' can be opened in a similar manner as described above, and as shown in FIG. 10, the release member 23' can be utilized in a similar manner as described above when the secondary lock 106 is disengaged as shown in FIGS. 9 and 10. Of course, it should be noted that the tang surface 28' can take a variety of forms, and further, as with all of the embodiments, the lock notch 54' can be a variety of types of locked notches where in some forms the lock notch does not lock but acts as a restricting device to keep the blade open. In one form, the edge portion 80' could for example not be a hard edge, but a slanted surface more similar to the tang indentation 52' so as to partially restrict the movement of the blade but not inhibit it. In other words, in one form of operation, the blade could be closed by simply pressing in a closing direction; however, the blade could be closed by way of inertia by pulling the forward region of the handle in a closing direction and applying the release member 23 into the orientation shown in FIG. 10 whereby the tang engagement portion 56' would disengage from the tang surface in a similar matter as shown in FIG. 7.

Figure 11:
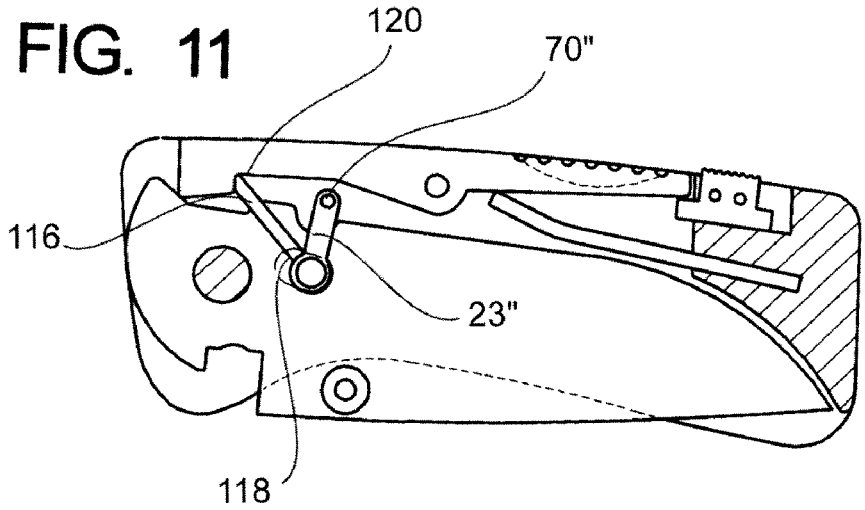
FIG. 11 shows another embodiment where the lock back bar in this form further is comprised with an immediate link to disengage the tang engagement portion from a tang of the blade.
Figure 12:
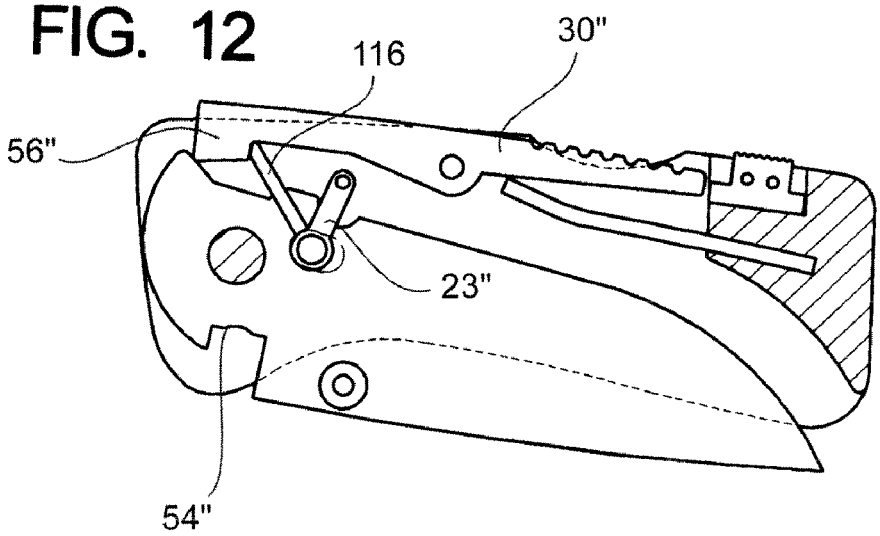
FIG. 12 shows the blade beginning to open with the immediate link member still in engagement with the lock back bar.

FIG. 11 shows another embodiment where the release member 23" is pivotally attached at the pivot location 70". In this configuration, an intermediate link member 116 is provided having a first end attached at the location 118 and a second end attached at the location 120. In this form, when the release lever 23" is repositioned to the second position as shown in FIG. 12, the intermediate link 116 is optionally configured to reposition the lock back bar 30" to the second position, which is of sufficient height so the tang engagement portion 56" can disengage from the lock notch 54" when the blade is in an open orientation (it should be noted that the blade is still in a closed orientation in FIG. 12, but the principle of the disengagement can be appreciated).

Figure 15:
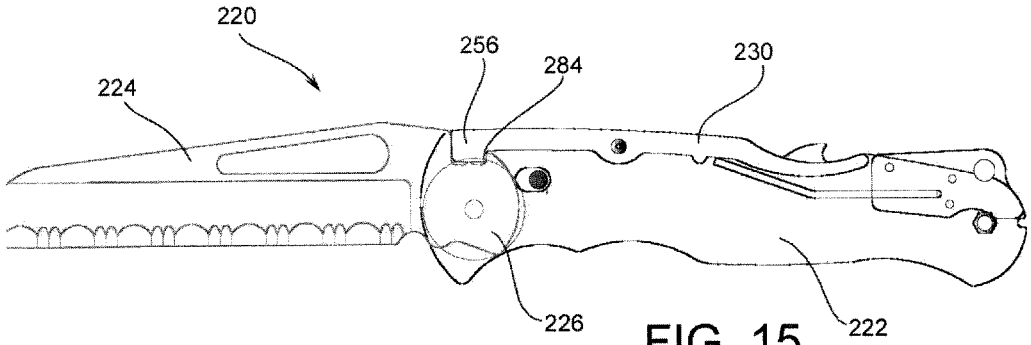
FIG. 15 shows another embodiment of a folding knife in an open orientation with the tang engagement portion engaged within a lock notch locking the blade open.
Figure 16:
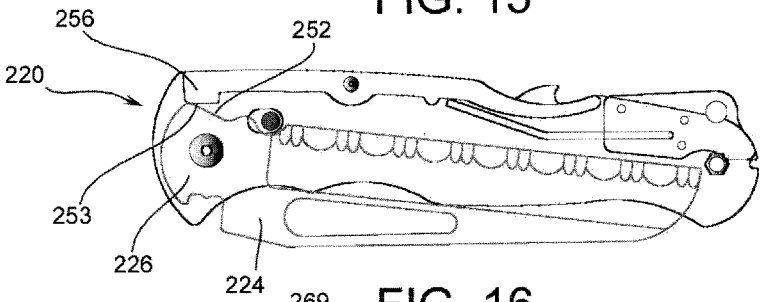
FIG. 16 shows the additional embodiment in a closed orientation where the tang engagement portion of the lock back bar biases the blade in a closed orientation.
Figure 17:
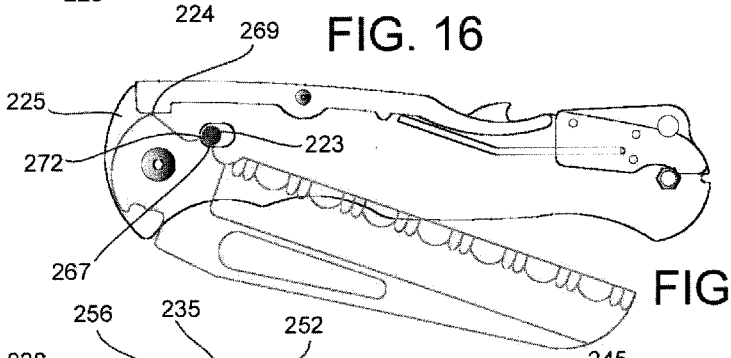
FIG. 17 shows the release mechanism biasing the blade to a partially open/non-closed orientation.
Figure 18:
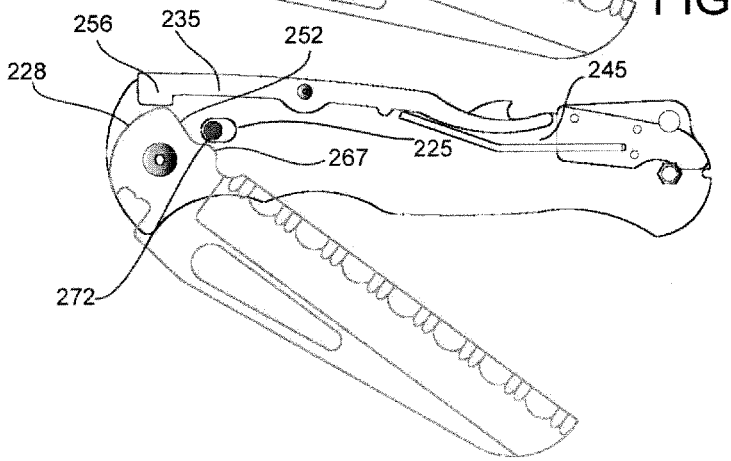
FIG. 18 shows the blade in a non-closed orientation where the tang engagement portion of the lock back bar is repositioned with respect to the handle, placing the lock back bar in a higher stored energy state allowing lower rotational resistance of the blade.

As shown in FIG. 15, there is another embodiment. In the following embodiments the numbering system will be incremented by "200" when possible (for example, two-digit previous numeral designations will be preceded by the numeral 2). Further, the following two embodiments will be incremented by "400 and "600" when possible As shown in FIGS. 15-18, the fourth embodiment generally shows a foldable knife 220 which has a lock back bar 230 which in one form is an actual lock bar or can be a resistance bar where the tang engagement portion 256 provides either a lock or frictional engagement with the tang region 246 of the blade 224. Referring ahead to FIG. 16, it can be seen how the folding knife 220 is in a folded or closed orientation. In this form the tang engagement portion 256 is in engagement with the tang indentation 252 of the tang region 226. As noted previously, the tang indentation which is a surface indicated at 253, is sloped in a manner so the biasing member 245 biases the lock back bar 230 so the force of the tang engagement portion 256 acts thereupon to bias the blade 224 to the closed orientation as shown in FIG. 16. Now referring to FIG. 17, it can be appreciated that the release mechanism 223 in this form operates under a similar principle as noted above, although through a different set of mechanical interactions. FIG. 17 shows the release mechanism 223 where the engagement surface 272 is engaged to the surface 267 which is contoured as shown in, for example, FIG. 18 to be an extension or otherwise provide an angle with respect to the engagement surface 272 to bias the blade towards an open orientation. As can be seen in FIGS. 17 and 18, the engagement surface, referred to also as the second engagement surface 269, is operatively configured to make contact with the lock back bar 230. As shown in FIG. 18, it can be appreciated that the tang engagement portion 256 is sufficiently engaged beyond the tang indentation 252 whereby the lock back bar 230 is in a higher stored energy state and now is in engagement with the more circular shaped tang surface indicated at 228. In other words, the release mechanism 223, which in this form is configured by the release system 225, is configured to reposition the blade which in turn by way of the engagement surfaces repositions the lock back bar 230 to a higher energy state where the biasing member 245 has stored energy therein. Therefore, the manual action overcomes a certain amount of force to reposition the blade to an orientation as shown in FIG. 18, whereby the blade can be flicked open or otherwise opened with less resistance incurred by which in one form is from the lock back bar 230. Referring now back to FIG. 15, it can be appreciated that the lock back bar can have the tang engagement portion 256 seated within the lock notch 254 of the blade 224. However, in the broader scope, the lock back bar of course need not physically lock the blade into the open orientation, but could for example provide a certain amount of resistance to maintain the blade 224 in the open orientation.

Figure 19:
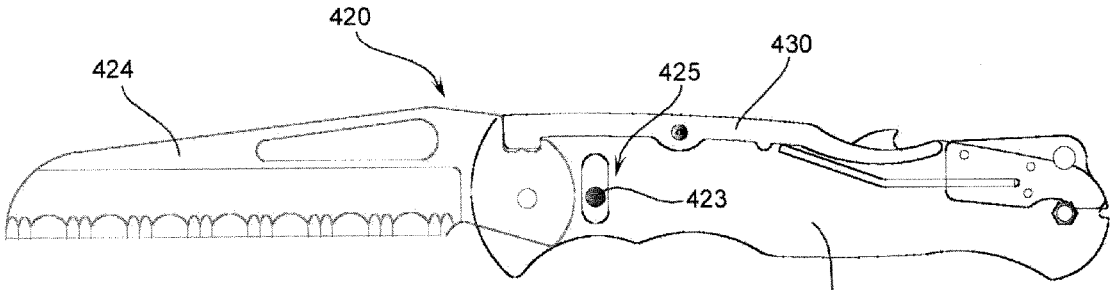
FIG. 19 shows another embodiment of a folding knife in an open orientation with a different release system.
Figure 20:
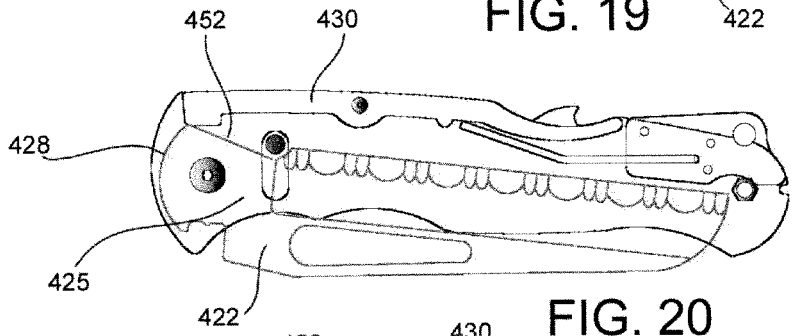
FIG. 20 shows the embodiment with the blade in a closed orientation.
Figure 21:
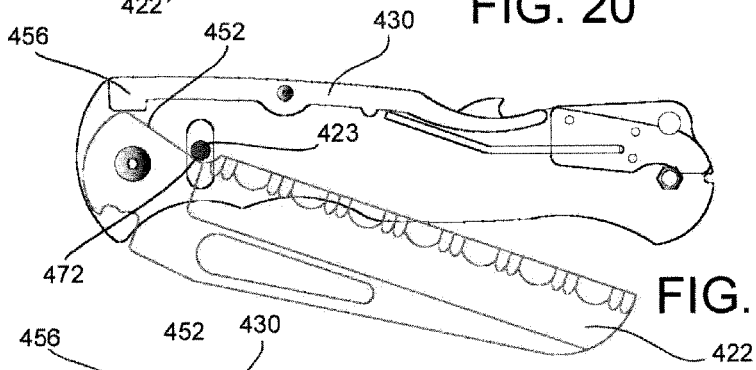
FIG. 21 shows the release mechanism partially engaging the blade to reposition a blade to a non-closed position.
Figure 22:
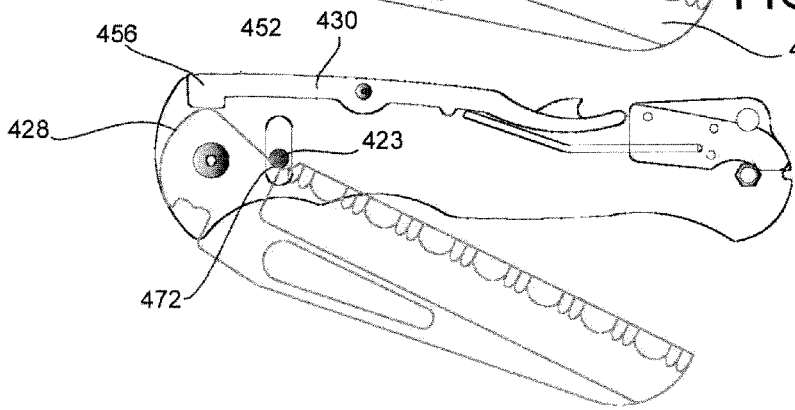
FIG. 22 shows the blade repositioned to a further open position with respect to that shown in FIG. 21 where the lock back bar is repositioned to a higher energy state.

Referring now to FIG. 19, there is shown another embodiment where the folding knife 420 has a release system 425. This form is comprised of a release mechanism 423 which is configured to reposition in a more transverse direction. As shown in FIG. 20, the lock back bar 430 is configured to engage the tang indentation 452, thereby biasing the blade to a closed orientation. Referring now to FIG. 21, it can be appreciated that the outer surface of the release mechanism 423 is configured to engage the surface 472 of the blade, thereby repositioning the blade 422 towards an open orientation. FIG. 22 shows the blade in an orientation where the tang surface 428 has reached a position with respect to the tang engagement portion 456 to reposition the lock back bar 430 to a greater stored energy state.

Figure 23:
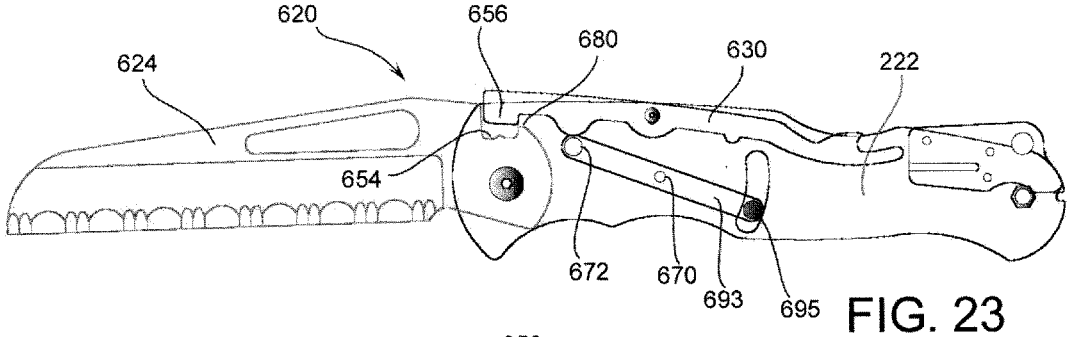
FIG. 23 shows another embodiment of the blade in an open orientation where the release mechanism is configured to disengage the tang engagement portion of the lock back bar from a lock notch of a blade.
Figure 24:
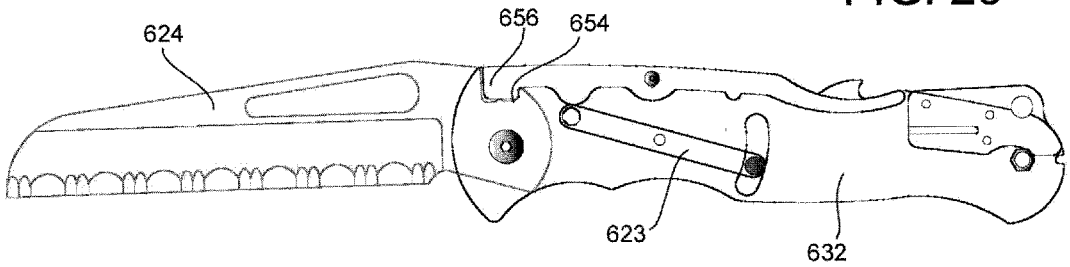
FIG. 24 shows the tang engagement portion of the lock back bar engaging the lock notch.

Now referring to FIGS. 23-27, there is shown another embodiment where the folding knife 620 is shown in FIG. 23 in an open orientation, but the tang engagement portion 656 is disengaged from the lock notch 654 of the blade 624. The release mechanism 623 is pivotally attached at the pivot attachment location 670 where the engagement surface 672 is configured to reposition the lock back bar when the lateral engaging member 695 is repositioned in a matter as shown in FIG. 23. FIG. 24 shows the release mechanism 623 repositioned in a manner so the lock back bar is in a lower energy state and the tang engagement portion 656 is in engagement within the lock notch 654.

Figure 25:
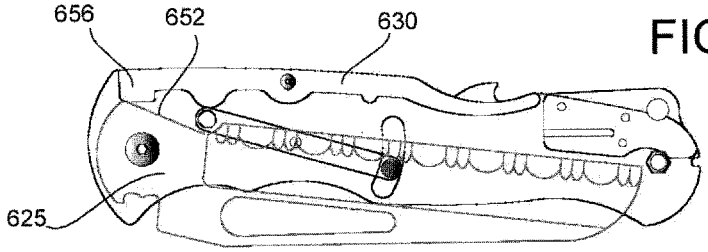
FIG. 25 shows the lock back bar engaging the tang indentation of the blade aiding in biasing the blade in a closed position.
Figure 26:
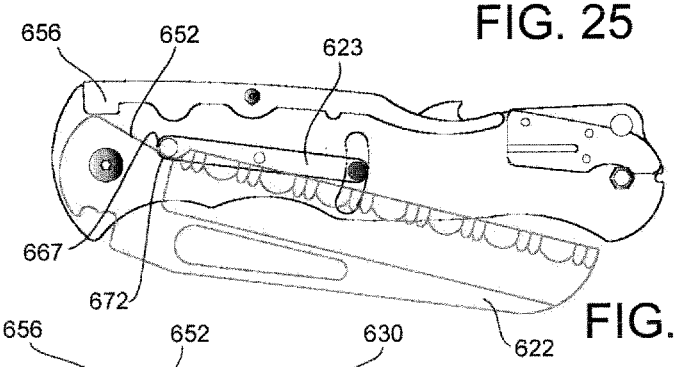
FIG. 26 shows the release mechanisms which in one form is repositioned in the opposite rotational direction with respect to that shown in FIG. 23, thereby biasing the blade to a non-closed position.
Figure 27:
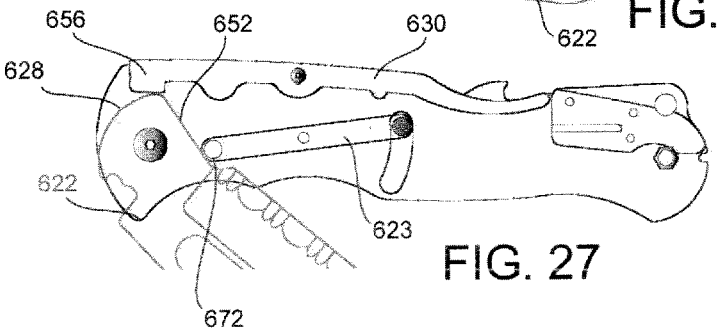
FIG. 27 shows the blade repositioned to a more open orientation than that of FIG. 26 wherein the tang engagement portion of the lock back bar is an engagement with the tang surface of the blade.

Now referring to FIGS. 25-27 there is shown another useful method of utilizing the release system 625 where the spring biasing member for the back bar 630 is not shown. FIG. 25 shows the blade in the closed orientation, and now referring to FIG. 26 it can be appreciated that the release mechanism 623 is repositioned in an opposing direction, as described immediately above, wherein the engagement surface 672 is in engagement with the surface 667 of the blade and is biasing the blade 622 to the partially open orientation. FIG. 27 shows the release mechanism 623 further repositioned in a substantially first transverse direction and further biasing the blade to a more open orientation. It should be noted in FIG. 27 that the tang engagement portion 656 is now in a position to be in a greater stored energy state and can more easily slide therealong the tang surface 628 with less rotational resistance of the blade 622. Of course the tang surface 628 can be of a variety of radii or alternating radius with respect to the rotational location therearound. As with the previous embodiments, this tang engagement surface could for example even be a gradually decreasing radius whereby some of the stored energy within the lock back bar 630 can propel the blade to an open orientation. Of course one method of utilizing the various embodiments is to activate the release system and reduce the rotational resistance upon the blade, which allows the user to accelerate their wrist motion to open the knife from the closed orientation to the open orientation without, for example, actually touching the knife in one form. Thereafter, the release system can be repositioned to allow the lock back bar to engage a lock notch in one form, or otherwise the tang engagement portion of the lock back bar engages the lock notch as the blade is positioned to the fully open orientation, as shown in FIGS. 15 and 19 above.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A locking system for a folding knife comprising:

a) a handle having a forward region and a rearward region, b) a blade pivotally attached to the handle at the forward region, the blade having a tang region with a tang surface, the tang surface comprising a tang indentation on the sharpened edge side of the blade, c) a lock back bar pivotally attached to the handle, the lock back bar having a tang engagement portion configured to engage the tang surface of the blade, d) a biasing member configured to bias the lock back bar so the tang engagement portion forcefully engages the tang surface, e) a release member operatively configured to reposition the lock back bar to lower the closing rotational resistance upon the blade, f) whereas the lock back bar is configured to be orientated to reposition in a direction away from the tang surface by repositioning the release member where the release member repositions the blade engaging member to lower the rotational resistance upon the blade and the lock back bar can independently reposition in a direction away from the tang surface by applying force directly to the lock back bar; wherein the release member being positioned to be pivotally attached to the handle so a cam surface of the release member engages the lock back bar, the release member having a lateral engagement member extending through a surface defining an opening in the handle on the lateral region of the handle.

2. The locking system as recited in claim 1 where the release member has a first position where the cam surface is such that a first contact location between the release member and the lock back bar is at a shorter distance than when the release member is in a second position where a second contact location between the cam surface of the release member and the lock back bar comprises a greater second distance than the first distance.

3. The locking system as recited in claim 1 where the lock back bar has a transverse engagement region which is configured to be pressed to disengage the tang engagement portion from the tang surface.

4. The locking system as recited in claim 1 where the tang surface is comprised of the tang indentation and a lock notch where the tang engagement portion of the lock back bar partially disengages from the tang engagement surface for a first portion of rotation of the blade with respect to the folding knife.

5. The locking system as recited in claim 4 where the tang engagement portion of the lock back bar is configured to engage the lock notch when the blade is in an open position, and when the release member is repositioned to a second position the tang engagement portion of the lock back bar disengages from the lock notch so the blade can reposition from the open position to the closed position.

6. The locking system as recited in claim 1 where the tang engagement portion of the lock back bar is configured to engage a lock notch when the blade is in an open position, and when the release member is repositioned to a second position the tang engagement portion of the lock back bar disengages from the lock notch so the blade can reposition from the open position to the closed position.

* * * * *